United States Patent [19]

Ito et al.

[11] Patent Number: 4,581,003

[45] Date of Patent: Apr. 8, 1986

[54] METHOD FOR MANUFACTURING AN ANGLED AND CYLINDRICAL CONTAINER

[75] Inventors: Sukenori Ito, Fuchu; Yoshiaki Take, Tama; Takahisa Hirayama, Kiryu, all of Japan

[73] Assignee: Toppan Printing Co., Ltd., Japan

[21] Appl. No.: 627,435

[22] Filed: Jul. 3, 1984

[30] Foreign Application Priority Data

| | | | |
|---|---|---|---|
| Jul. 8, 1983 | [JP] | Japan | 58-124446 |
| Jul. 8, 1983 | [JP] | Japan | 58-124447 |
| Jul. 8, 1983 | [JP] | Japan | 58-124448 |
| Jul. 8, 1983 | [JP] | Japan | 58-124450 |

[51] Int. Cl.[4] ..... B31B 1/28

[52] U.S. Cl. ..... 493/153; 493/102; 493/111; 493/114

[58] Field of Search ..... 493/101, 104, 105, 107, 493/108, 111, 152, 153, 303, 308

[56] References Cited

U.S. PATENT DOCUMENTS

| | | | |
|---|---|---|---|
| 1,262,289 | 4/1918 | Weber | 220/468 |
| 2,037,777 | 4/1936 | Gazette | 493/152 |
| 2,063,013 | 12/1936 | Cooper | 493/152 |
| 4,106,397 | 8/1978 | Amberg et al. | 493/105 |
| 4,306,849 | 12/1981 | Cress et al. | 493/108 |

FOREIGN PATENT DOCUMENTS

| | | | |
|---|---|---|---|
| 3015112 | 10/1981 | Fed. Rep. of Germany | 493/152 |

*Primary Examiner*—Francis S. Husar
*Assistant Examiner*—Robert Showalter
*Attorney, Agent, or Firm*—Lerner, David, Littenberg, Krumholz & Mentlik

[57] ABSTRACT

A method for manufacturing a container for filling with juice or the like at a high temperature includes applying a container body to a mandrel having an outer surface corresponding to the shape of a cylinder and a plurality of recessed portions located about the circumference of the mandrel. The recessed portions are inwardly recessed from the substantially cylindrical outer surface and are separated by a plurality of connecting portions corresponding substantially to the cylindrical outer surface. The container body is subjected to vacuum attraction through a plurality of apertures provided in the mandrel whereby the container body is drawn into the plurality of recessed portions to conform the shape of the container body to the shape of the mandrel. The container is thereafter disengaged from the mandrel by feeding compressed air through the plurality of apertures of the mandrel.

10 Claims, 12 Drawing Figures

FIG.10
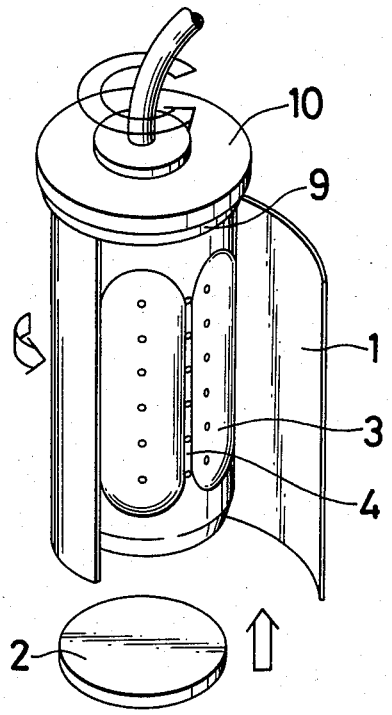
FIG.11
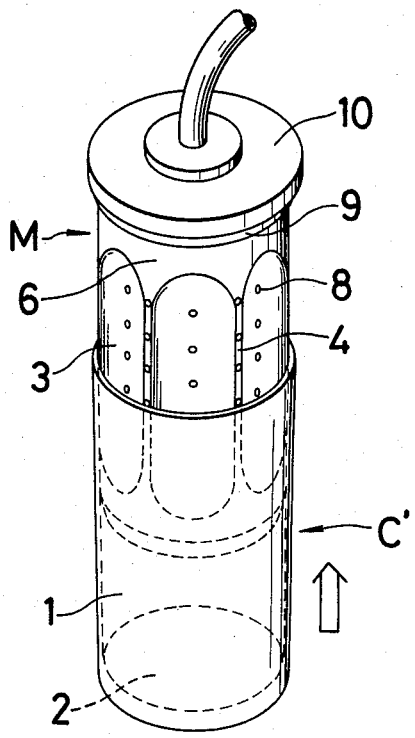
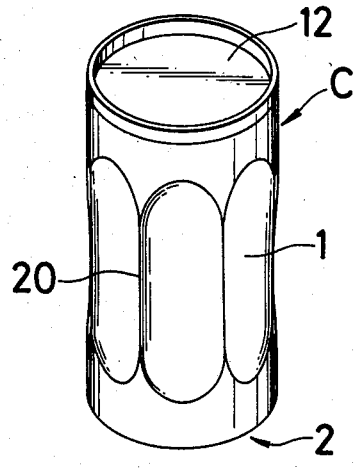
FIG.12

METHOD FOR MANUFACTURING AN ANGLED AND CYLINDRICAL CONTAINER

FIELD OF THE INVENTION

The present invention relates to a method for manufacturing a paper container in which a body portion is formed into a polygonal shape in cross-section in order to prevent the body portion from being deformed into an irregular shape due to a pressure difference between the interior and exterior of the container produced when the contents are cooled after the container has been filled with juice or the like at a high temperature and sealed. A preliminarily formed container, wherein a closing member is secured to one of upper and lower open ends of a cylindrical body member, is mounted on a mandrel, which is polygonal and has a cross-sectional shape in which the sides constituting a polygon are inwardly curved, and the body member is subjected to vacuum attraction through a hole provided in the mandrel and is depressed while adjusting to the cross-sectional shape of the mandrel to form a polygon.

DESCRIPTION OF THE PRIOR ART

In the past, in a paper container for filling with juice or the like at a high temperature a method has been known in which creases of regular shape are provided on a body portion and portions surrounded by the creases are intentionally deformed to prevent depression and irregular deformation of a container caused by a negative pressure phenomenon resulting from cooling of filled contents after having been filled and sealed. However, even in the case of the container in which the body portion is formed with the creases, the body portion itself is formed of a relatively thick material in terms of strength and has a considerable rigidity, and therefore, the container is not always deformed (depressed) into a shape as initially set but it is awkardly deformed to impair quality and appearance.

In view of the foregoing, as means for solving the above-described problems, a method has been proposed in which not only creases are provided on the body portion but portions surrounded by the creases and to be deformed due to the negative pressure phenomenon are depressed beforehand to some extent prior to filling with contents to intentionally and regularly produce deformation due to the negative pressure phenomenon after the container has been filled.

To realize such a method as described above, the present inventor has already filed a U.S. patent application Ser. No. 388,689 filed on June 15, 1982.

In the manufacturing method of this application, the body portion is pressed from the outside on the mandrel and formed by a vertically movable jig. However, this application has problems in that since the process is complicated, the operating efficiency is low, damage to the surface of the body portion such as by wrinkling sometimes occurs impairing the appearance, it is difficult to evenly press the whole body member and it is difficult to sufficiently depress the body portion.

SUMMARY OF THE INVENTION

The present invention relates to a method for manufacturing a container in which closing members are provided on upper and lower open ends of an angled and cylindrical body portion. A closing member is secured to one open end of a cylindrically formed body member to form a preliminarily formed container. The preliminarily formed container is mounted on a mandrel, which has a sectional shape of a curved surface obtained by inwardly depressing the sides of a suitable polygon and in which each surface thereof is provided with small holes in connection with an inner attractive hole. The body portion is subjected to vacuum attraction through the attractive hole and depressed while adjusting to the sectional shape of the mandrel. Compressed air is fed through the attractive hole to disengage the preliminarily formed container from the mandrel to form an angled and cylindrical container.

BRIEF DESCRIPTION OF THE DRAWINGS

FIG. 10 is a perspective view showing a first embodiment in which a preliminarily formed container is mounted on the mandrel;

FIG. 11 is a perspective view showing the second embodiment; and

FIG. 12 is a perspective view showing a container manufactured by the manufacturing method of the present invention.

DESCRIPTION OF THE PREFERRED EMBODIMENTS

Embodiments of the present invention will be described with reference to the drawings.

Figure 1:
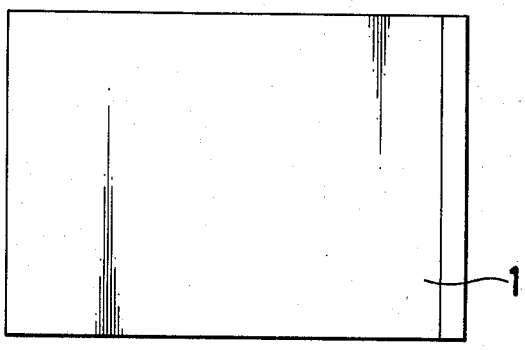
FIG. 1 is a developed view of a first embodiment of a body member of a container according to the present invention.
Figure 4:
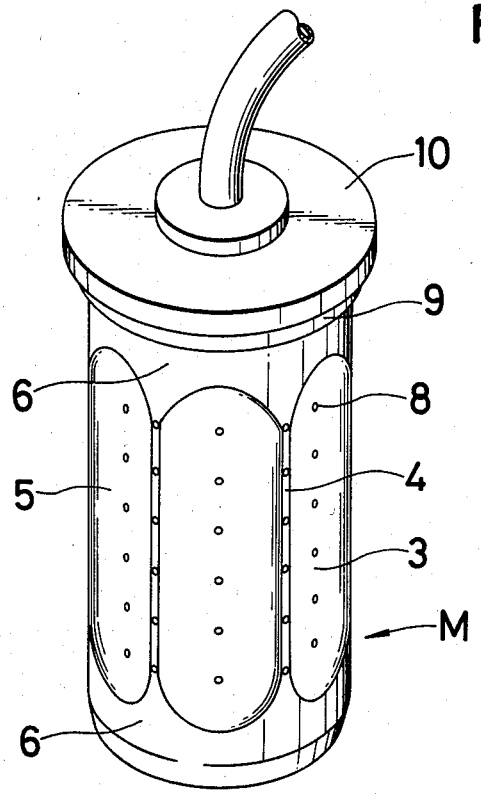
FIG. 4 is a perspective view of a mandrel used in connection with the present invention.
Figure 5:
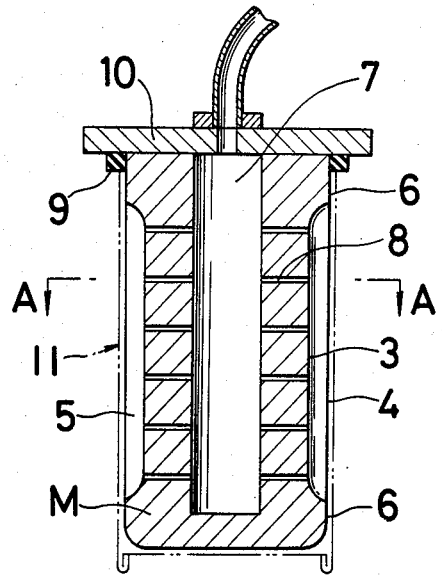
FIG. 5 is a side view of the side portion of the same.
Figure 6:
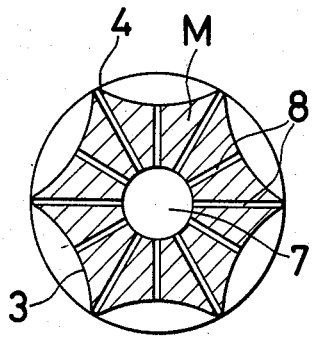
FIG. 6 is a sectional view taken on line A—A of FIG. 5.

A square-shaped body member 1, which is square as shown in FIG. 1, is formed of a laminated material composed of a combination of at least two materials such as paper, synthetic resin and metal foil. A mandrel which forms the body member 1 into a preliminarily formed container C' (shown in FIG. 11) is formed into curved surfaces 3 by inwardly depressing sides of a suitable polygon as shown in FIGS. 4, 5 and 6, and projected portions 4 are formed on boundaries between the adjacent curved surfaces 3, 3 to provide a sectional shape like a starfish. Adjacent upper and lower portions of the projected portions 4 are continuously joined to each other in a circular fashion to provide body forming recess portions 5 having ends shaped to restrict said curved surfaces 3. Cylindrical portions 6, 6 equal in outside diameter to the projected portions 4 are provided on upper and lower portions of the recess portions 5. The suitable number of small holes 8, which are in connection with an attractive hole 7 axially provided, are provided in the surface of the body-forming recess portions 5. One end of the side of the body member 1 is held by a holder (not shown) having a groove, which is provided within the projected portion 4 on the mandrel M with a keep member 10 through a packing 9 at the upper end thereof and which has the same construction as that normally used during molding of a cup. As shown in FIG. 10, the mandrel M is rotated and wound while bringing an upper end of the body member 1 into abutment with the lower end of the packing 9, and the mandrel M is rotated once so that the other side end of the body member 1 is superposed, in which state, they are adhered together by way of a supersonic seal or heat seal to form a cylindrical configuration. A disc-like closing member 2 separately prepared on an open end of the body member 1 is fixed by the same means as the method normally used for manufacturing a bottom of a paper cup so that it is formed into a preliminarily formed container C'.

Figure 7:
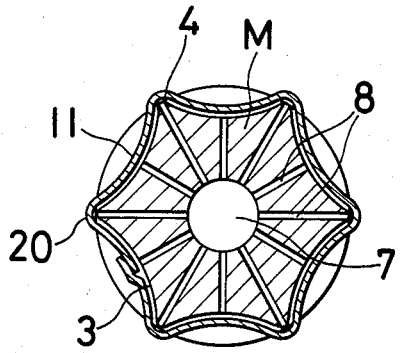
FIG. 7 is a sectional view taken on line A—A showing a body member of a container depressed.
Figure 8:
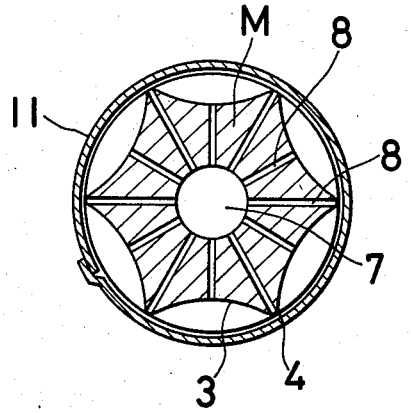
FIG. 8 is a sectional view taken on line A—A in which a preliminarily formed container which has used the body member of FIG. 1 is mounted on the mandrel.

Vacuum attraction is carried out through the small holes 8, by a vacuum attraction source (not shown) in connection with the attractive hole 7 through the hole provided in the center of the keep member 10 of the mandrel M, to depress the body member 1 along the curved surfaces 3 of the mandrel M. As a consequence, a portion of the body member 1 where it contacts the projected portion 4 of the mandrel M is an edge line 20 and similarly, a portion thereof where it contacts the curved surface 3 is to be inwardly depressed. Therefore, as shown by the oblique lines of FIG. 7, a prismatic (more than a triangle) body portion 11 whose each surface is inwardly depressed is formed which body portion coincides with a sectional shape of the mandrel M.

Next, a preliminarily formed container C' having the body portion 11 is disengaged from the mandrel M by feeding compressed air from the small holes 8 through the attractive hole 7 conversely to the vacuum attraction.

Thereafter, juice or the like is filled at a high pressure and temperature of approximately 90° C. (194° F.) from an unclosed open end, and a separately prepared closing member 12 is fixed to form a container C (shown in FIG. 12).

In a further embodiment of the present invention other than the above-described embodiment, in forming a preliminarily formed container C', both ends of the body member 1 are adhered beforehand as shown in FIG. 11 by a process separate from the manufacturing method of the present invention to provide a cylindrical configuration, and a closing member 2 is fixed to one open end and molded, after which it is mounted on the mandrel M so that the open end contacts the lower end of the packing 9 to form an angled and cylindrical body portion 11.

Figure 2:
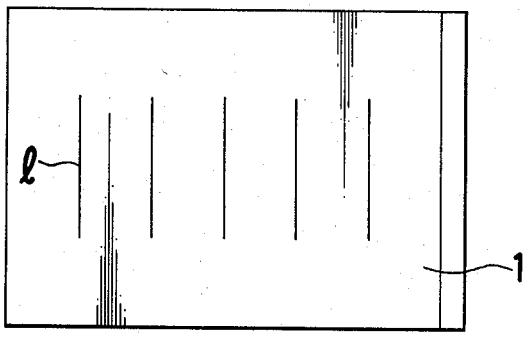
FIG. 2 is a developed view of a second embodiment of the same.
Figure 3:
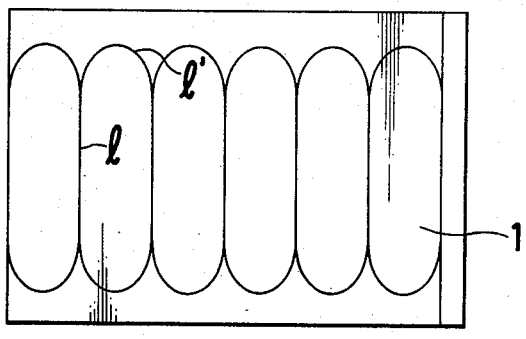
FIG. 3 is a developed view of a third embodiment of the same.
Figure 9:
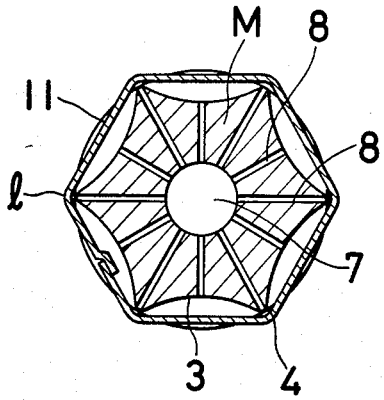
FIG. 9 is a sectional view taken on line A—A which likewise uses the body member of a container shown in FIG. 2.

As shown in FIG. 2, straight creases l are provided beforehand on the body member 1 at the intervals substantially equal in length to the distance between the projected portions 4 adjacent each other on the mandrel M, and more preferably, as shown in FIG. 3, creases l' by which adjacent upper and lower ends of the creases l are continuously joined in arc-shaped fashion. Then, the body portion 11 will be an angled and cylindrical configuration when the preliminarily formed container is formed. Therefore, when it is mounted on the mandrel M for vacuum attraction, the distance between the deepest portion of the curved surface 3 of the mandrel M and the body member 1 is extremely short as compared with the preliminary formed container formed of a flat body member as in the abovedescribed embodiment as shown in FIG. 9. In addition, a portion in the vicinity of the edge line 20 which is the most difficult to form and a portion by which upper and lower ends of the edge line 20 are joined in a circular fashion have been formed as the creases l and l' to some extent, and therefore, it is possible to form a depression simply and clearly by the body portion 11.

If the small holes 8 for attraction and disengagement provided in the mandrel M are provided not only in the curved surfaces 3 but in the projected portions 4, a portion in the vicinity of the edge line 20 of the body portion 11 to which a greatest load is applied is brought powerfully into close contact with the projected portion 4 of the mandrel M to form a more definite edge line 20.

As described above, in the present invention, as opposed to a conventional method for pressing a body member on the mandrel by mechanical means from outside, the body member can be depressed by vacuum attraction inwardly of the mandrel without making any other jig or the like contact the body member. Therefore, the surface of the body member is not scratched nor wrinkled to accurately provide a polygonal configuration without impairing its external appearance. Moreover, since in the conventional pressing system, the body member is to be bent by movement of the jig, if attending to one point of the body member, the jig merely passes through once whereas in the system of the present invention, the vacuum attractive force is simultaneously applied to the whole body member, and therefore, non-smoothing time can be prolonged to accurately provide a polygonal configuration.

There are two methods for mounting a preliminarily formed container on a mandrel, one is to effect this after a preliminarily formed container is preformed, and the other is to effect his simultaneously while forming a preliminarily formed container on the mandrel. These methods are selectively employed.

Furthermore, if creases are provided beforehand on a body member of a prelimarily formed container, a body portion can be easily depressed by vacuum attraction into a polygonal configuration and a beautiful shape in conformity with the creases may be obtained.

What is claimed is:

1. A method for manufacturing a paper container so as to provide for uniform deformation of said paper container upon reduction of the pressure therewithin, said method comprising applying a container body comprising paper to the outer surface of a mandrel, said outer surface substantially corresponding to the shape of a cylinder and including a plurality of recessed portions located about the circumference of said mandrel, said plurality of recessed portions being inwardly recessed from said substantially cylindrical outer surface and being separated by a plurality of connecting portions corresponding to said substantially cylindrical outer surface, including a plurality of apertures connecting said plurality of recessed portions with a central channel within said mandrel, said method including applying a vacuum through said plurality of apertures to draw said container body into said plurality of recessed portions and thereby produce creases in said container body which temporarily conform the shape of said container body to the shape of said recessed portions of said mandrel, and applying pressure through said plurality of apertures to remove said container body from said mandrel, whereby said container body, including said creases, returns to a substantially cylindrical configuration, and upon the creation of a negative pressure within said container body said container body can uniformly deform to correspond with the shape provided by said creases.

2. The method of claim 1 wherein said step of applying said container body to the outer surface of said mandrel comprises preliminarily forming said container body on said mandrel by winding said container body about said mandrel, and superimposing and joining opposed ends of said container body on said mandrel.

3. The method of claim 1 wherein said step of applying said container body to said mandrel comprises preliminarily forming said container body into a substantially cylindrical shape prior to applying said container body to the outer surface of said mandrel by superimposing and joining opposed ends of said container body to form said substantially cylindrical shape and subsequently applying said substantially cylindrical container body to said mandrel.

4. The method of claim 1 including securing a closure member to one open end of said cylindrical container body prior to applying said vacuum.

5. The method of claim 1 wherein said step of applying pressure through said plurality of apertures comprises injecting compressed air through said apertures.

6. The method of claim 4 including subsequently securing a second closure member to the other open end of said cylindrical container body subsequent to said removal of said container body from said mandrel.

7. The method of claim 1 wherein said plurality of recessed portions are provided in an intermediate portion of said mandrel, said intermediate portion of said mandrel having a cross-sectional configuration corresponding to a polygon whose sides are inwardly depressed to form curved surfaces, and wherein the upper and lower portions of said mandrel surrounding said intermediate portion have a substantially cylindrical configuration, whereby said step of applying said vacuum through said plurality of apertures results in the formation of a container having intermediate and upper and lower portions which conform to the shape of said mandrel.

8. The method of claim 1 including providing linear creases extending longitudinally along said container body at a plurality of locations intended to correspond with said plurality of connecting portions on said mandrel when said container body is applied to said mandrel.

9. The method of claim 8 including providing additional substantially transverse creases connecting the upper and lower ends of said linear creases so as to continuously join said creases to each other on said container body.

10. The method of claim 1 wherein said plurality of apertures comprises a first plurality of apertures, and wherein said mandrel includes a second plurality of apertures connecting said plurality of connecting portions with said central channel within said mandrel, whereby said step of applying a vacuum through said plurality of apertures comprises applying a vacuum through said first and second plurality of apertures whereby said vacuum is applied to substantially said entire container.

* * * * *